US009661965B2

(12) United States Patent
Fukunaga et al.

(10) Patent No.: US 9,661,965 B2
(45) Date of Patent: May 30, 2017

(54) BACKPACK WORK APPARATUS

(71) Applicant: MAKITA CORPORATION, Aichi (JP)

(72) Inventors: Ko Fukunaga, Aichi (JP); Yoshinori Shibata, Aichi (JP); Takuro Konishi, Aichi (JP); Ryoichi Shimooka, Aichi (JP)

(73) Assignee: MAKITA CORPORATION, Aichi (JP)

( * ) Notice: Subject to any disclaimer, the term of this patent is extended or adjusted under 35 U.S.C. 154(b) by 411 days.

(21) Appl. No.: 14/523,195

(22) Filed: Oct. 24, 2014

(65) Prior Publication Data

US 2015/0113759 A1 Apr. 30, 2015

(30) Foreign Application Priority Data

Oct. 25, 2013 (JP) ..... 2013-222772

(51) Int. Cl.
*A47L 5/36* (2006.01)
*A45F 3/10* (2006.01)
*A45F 3/08* (2006.01)

(52) U.S. Cl.
CPC *A47L 5/36* (2013.01); *A45F 3/10* (2013.01); *A45F 3/08* (2013.01)

(58) Field of Classification Search
CPC ..... A47L 5/36; A45F 3/10; A45F 3/08; A45F 3/14; A45F 3/04; A45F 5/00; A45F 3/047
See application file for complete search history.

(56) References Cited

U.S. PATENT DOCUMENTS 5,240,159 A * 8/1993 Gregory ..... A45F 3/04 224/264
5,341,974 A * 8/1994 Robinson ..... A45F 3/047 224/633
5,361,955 A * 11/1994 Gregory ..... A45F 3/04 224/630
9,173,473 B2 * 11/2015 Gleason ..... A45F 3/047
2009/0057360 A1 * 3/2009 Demsky ..... A45F 3/047 224/262

FOREIGN PATENT DOCUMENTS

JP 2008-2310 1/2008

* cited by examiner

*Primary Examiner* — Dung Van Nguyen
(74) *Attorney, Agent, or Firm* — Greenblum & Bernstein, P.L.C.

(57) ABSTRACT

A backpack work apparatus comprises a back carrier frame; a drive motor mounted on the back carrier frame; a work tool driven by the drive motor; a right and left shoulder straps; a chest strap linking the intermediate points of the right and left shoulder straps; and an emergency release buckle device provided at the point where the chest strap is coupled to the intermediate point of the left shoulder strap, which is divided by the buckle device into two parts, an upper strap and a lower strap. The buckle device normally buckles the chest strap, the upper strap and the lower strap, and is capable of releasing the lower strap and the chest strap from the upper strap via a one part motion in an emergency.

5 Claims, 7 Drawing Sheets

BACKPACK WORK APPARATUS

TECHNICAL FIELD

The present invention relates to a backpack work apparatus such as a backpack blower apparatus, a backpack suction apparatus and a backpack vegetation cutter comprising a back carrier frame, a drive motor mounted on the back carrier frame, a work tool driven by the drive motor, a pair of right and left shoulder straps for piggybacking or shouldering the back pack carrier frame, and a chest strap for linking the right and left shoulder straps. More particularly, the present invention relates to a backpack work apparatus in which an emergency release buckle device is provided at the point where the chest strap is coupled to the intermediate point of one of the shoulder straps, dividing the shoulder strap into an upper strap and a lower strap, so that at least two of the chest strap, the upper strap and the lower strap can be released via one motion in case of emergency.

BACKGROUND OF THE INVENTION

Backpack work apparatuses have been conventionally known and used in the art, particularly in the cases of power-operated machines including a heavy work unit or tool. Among such backpack work apparatuses, JP 2008-002310 A discloses a backpack blower apparatus with a power-operated blower unit for blowing out air through an airflow tube. The disclosed backpack blower apparatus comprises a back carrier frame to be piggybacked or shouldered by an operator, an engine mounted on the back carrier frame, a blower unit driven by the engine, and an airflow tube fluidically coupled to the blow-out duct of the blower unit to blow out air from the distal end of the airflow tube. The backpack blower apparatus is provided with shoulder straps for piggybacking the back carrier frame.

In the case of the backpack blower apparatus disclosed in the above cited JP publication, the engine mounted on the back carrier frame is a kind of heavy machine, and therefore it would be preferable, if a chest strap is provided over the operator's breast to link the right and left shoulder straps to prevent the shoulder straps from slipping away from the shoulders, thereby stabilizing the shouldering conditions. In such a case, the chest strap would be fixedly connected to the right and left shoulder straps at its both ends and would be divided into two parts, a right and left pieces, at its center and releasably coupled together by means of a buckle device at the divided ends.

Linking the shoulder straps with a chest strap will help to stabilize the shouldering condition of the back carrier frame on the one hand, but may cause a kind of inconvenience of taking time to unshoulder the backpack apparatus on the other hand. In case of some trouble with the blower unit, it will be necessary to quickly unshoulder the piggybacked apparatus. Under such a circumstance, however, unbuckling the buckle device, pushing the right and left shoulder straps apart, and removing both of the shoulder straps from the operator's body would take a considerable length of time, and it would be accordingly hard for the operator to quickly get rid of the blower apparatus from his/her back.

BRIEF SUMMARY OF THE INVENTION

In view of the foregoing circumstances, therefore, it is a primary object of the present invention to provide a backpack work apparatus which shall be stably held on the operator's back during the work and can be quickly removed from the operator's back in case of emergency.

According to the present invention, the object is accomplished by providing a backpack work apparatus comprising: a back carrier frame to be piggybacked by an operator, the back carrier frame having an upper part and a lower part; a drive motor mounted on the back carrier frame; a work tool driven by the drive motor; a pair of right and left shoulder straps each coupled to the back carrier frame for the operator to piggyback the back carrier frame, each of the shoulder straps having an upper end, a lower end and an intermediate point, the upper end being connected to the upper part of the back carrier frame and the lower end being connected to the lower part of the back carrier frame; a chest strap for linking the right and left shoulder straps, the chest strap having a first end joined to the intermediate point of one of the shoulder straps and a second end joined to the intermediate point of the other of the shoulder straps; and an emergency release buckle device provided at the point where the first end of the chest strap is joined to the intermediate point of the one of the shoulder straps, the buckle device dividing the one of the shoulder straps into two parts, an upper strap and a lower strap, the upper strap forming a first coupling end toward the buckle device, the lower strap forming a second coupling end toward the buckle device and the first end of the chest strap constituting a third coupling end toward the buckle device, the buckle device normally buckling the first coupling end, the second coupling end and the third coupling end together, and being capable of releasing at least two of the first, second and third coupling ends from the buckle device via a one part motion.

With the above configured backpack work apparatus comprising an emergency release buckle device provided at the point where the first end of the chest strap is joined to the intermediate point of the one of the shoulder straps, wherein the buckle device normally buckles the coupling end of the upper strap, the coupling end of the lower strap and the coupling end of the chest strap together, and is capable of releasing at least two of the coupling ends from the buckle device via a one part motion, a single manipulating motion shall disconnect one of the shoulder straps apart and also the chest strap apart at a time, so that the operator can easily and quickly remove the shoulder straps from his/her body and put the back carrier frame down.

In the backpack work apparatus according to the present invention, the emergency release buckle device may preferably include: two plugs respectively provided at two of the first, second and third coupling ends; a socket fixed to the remaining one of the first, second and third coupling ends, the socket having two recesses for respectively receiving the two plugs; and a rotary latch rotatably provided on the socket to assume a locked position and a released position and having hook members for selectively latching both of the plugs when the rotary latch is in the locked position and unlatching both of the plugs when the rotary latch is in the released position via a one part motion. With this configuration, a single manipulating motion of rotating the rotary latch shall uncouple the chest strap from the one of the shoulder straps as well as disconnect the one of the shoulder straps to be easily removable from the shoulder of the operator, which will allow the operator to quickly put the backpack apparatus down. In addition, as the rotary latch is employed for buckling the three coupling ends of the straps by a rotational motion, a mere pushing or touching on the latch knob will not release the buckle device, and the accidental or unintended disconnection of the straps will be prevented.

In the backpack work apparatus according to the present invention, the socket may preferably be provided with an urging member for urging the rotary latch to the locked position to normally latch both of the plugs. With this configuration, the rotary latch is prevented from accidentally rotating from the locked position to the released position, when the rotary latch is not manipulated, which in turn prevents the latched straps from being unintentionally disconnected.

In the backpack work apparatus according to the present invention, the rotary latch may preferably include a latch knob in the shape of a circular disk having a diametrical area and a circumferential area and formed with recesses between the diametrical area and the circumferential area on both side of the diametrical area, thereby providing along the diametrical area a pinch member to be manipulated by the operator. With this configuration, the pinch member of the rotary latch will not easily touch or push the hand or other part of the operator's body accidentally.

BRIEF DESCRIPTION OF THE SEVERAL VIEWS OF THE DRAWING

For a better understanding of the present invention, and to show how the same may be practiced and will work, reference will now be made, by way of example, to the accompanying drawings, in which.

DETAILED DESCRIPTION OF THE INVENTION

Figure 1:
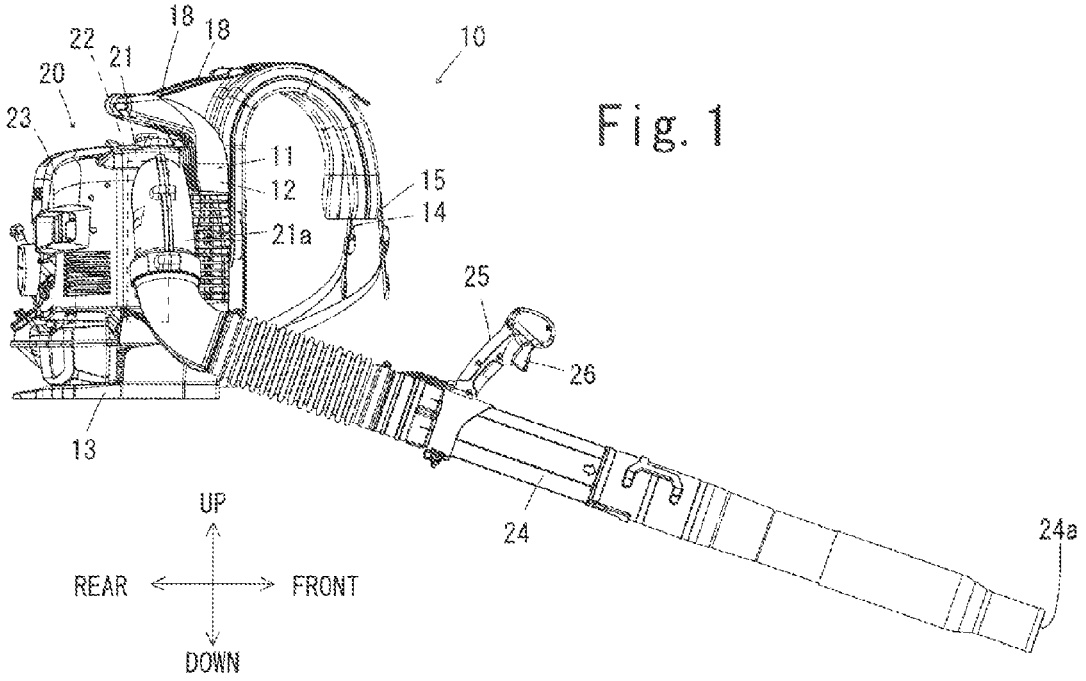
FIG. 1 is a side view of a backpack blower apparatus as a first embodiment of the present invention.

The invention and its various embodiments can now be better understood by turning to the following detailed description of the preferred embodiments with reference to the accompanying drawings. The embodiments of the backpack work apparatuses hereunder described are a backpack blower apparatus, a backpack suction apparatus and a backpack vegetation cutter.

It should be expressly understood that the illustrated embodiments are presented just as practicable examples of the invention and that the invention as defined by the claims may be broader than the illustrated embodiments described below. In the drawing, like reference characters refer to like parts so that repetitive explanations may be omitted.

First to be described with reference to the accompanying drawings is a backpack blower apparatus as an embodiment of the backpack work apparatus according to the present invention. FIG. 1 illustrates a backpack blower apparatus 10, which comprises a back carrier frame 11 for being piggybacked or shouldered by the operator, a blower unit 20 mounted on the back carrier frame and including a blow-out duct 21*a* for blowing out air therefrom, and an airflow tube 24 coupled to the blow-out duct 21*a* for blowing out air ahead.

As shown in FIG. 1, the back carrier frame 11 is for the operator to carry the blower unit 20. The back carrier frame 11 comprises a back support member 12 for resting against the back of the operator and a base support member 13 extending backward from the bottom portion of the back support member 12 for supporting the blower unit 20, constituting a generally L-shaped configuration in the side view.

Figure 2:
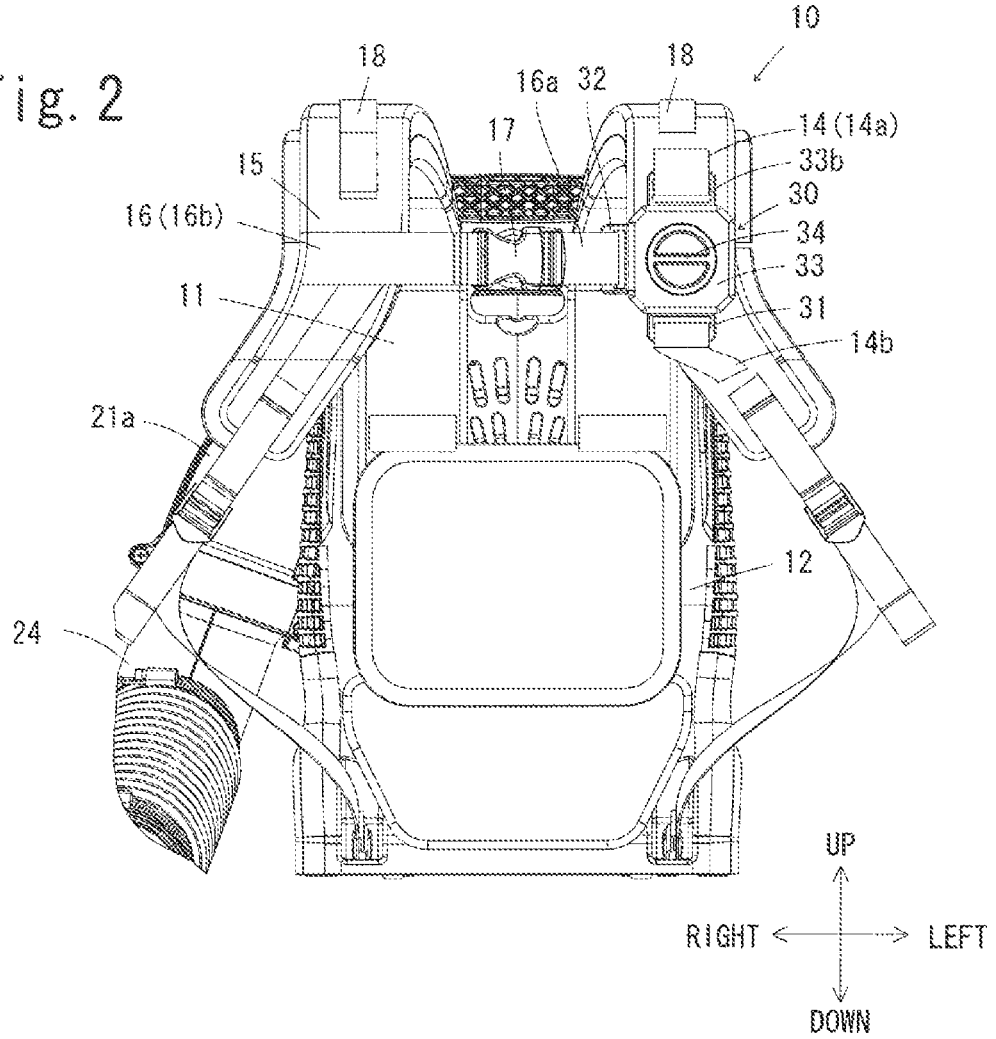
FIG. 2 is a front view of the backpack blower apparatus of FIG. 1.

As shown in FIG. 2, to the back support member 12 of the back carrier frame 11 are fixed a left shoulder strap 14 and a right shoulder strap 15 for the operator to piggyback the backpack blower apparatus 10. The left shoulder strap 14 is comprised of an upper strap 14*a* having an upper end coupled to the upper part of the back carrier frame 11 and a lower strap 14*b* having a lower end coupled to the lower part of the back carrier frame 11. The lower end of the upper strap 14*a* and the upper end of the lower strap 14*b* are releasably coupled together by means of an emergency release buckle device (to be described hereinafter) to cooperatively constitute the left shoulder strap 14. The right shoulder strap 15 has an upper end coupled to the upper part of the back carrier frame 11 and a lower end coupled to the lower part of the back carrier frame 11.

As shown in FIG. 2, the right and left shoulder straps 15, 14 are linked by a chest strap 16 in front of the chest of the operator. The chest strap 16 is comprised of a left strap 16*a* and a right strap 16*b*, which two are releasably (detachably) coupled together by means of a buckle 17.

Figure 3:
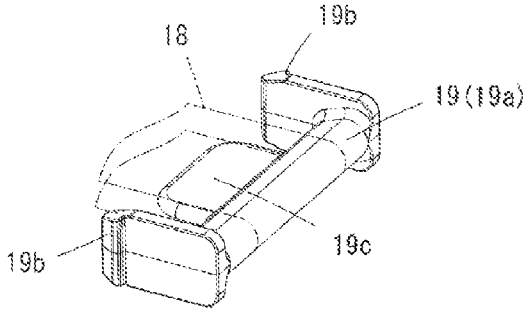
FIG. 3 is a perspective view of a hook for fixing a stabilizer strap to the back carrier frame.
Figure 4:
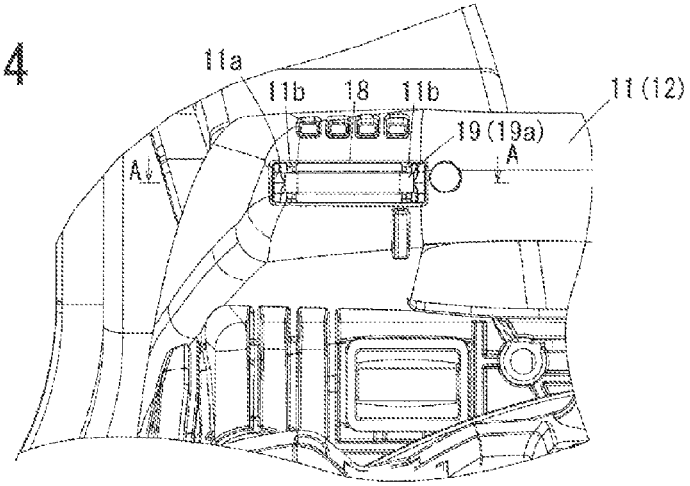
FIG. 4 is an enlarged partial view, taken from the rear, of the backpack blower apparatus, for showing the hook fixed to the back carrier frame.

As shown in FIG. 1, stabilizer straps 18, 18 are provided between the upper of the shoulder straps 14, 15 and the upper part of the back carrier frame 11. Each of the stabilizer straps 18, 18 has a front end part fixed to the curved top part of each of the right and left shoulder straps 15, 14 and a rear end part detachably coupled to the top part of the back carrier frame 11. The stabilizer straps 18, 18 serve to prevent the back carrier frame 11 from tilting backward due to the weight of the blower unit 20 mounted thereon. The rear end part of each of the stabilizer straps 18, 18 is provided with a hook 19 as shown in FIG. 3. As shown in FIG. 4, the hook 19 engages a retaining recess 11*a* of the back carrier frame 11 so that the rear end part of each of the stabilizer straps 18, 18 is detachably connected to the back carrier frame 11.

Figure 5:
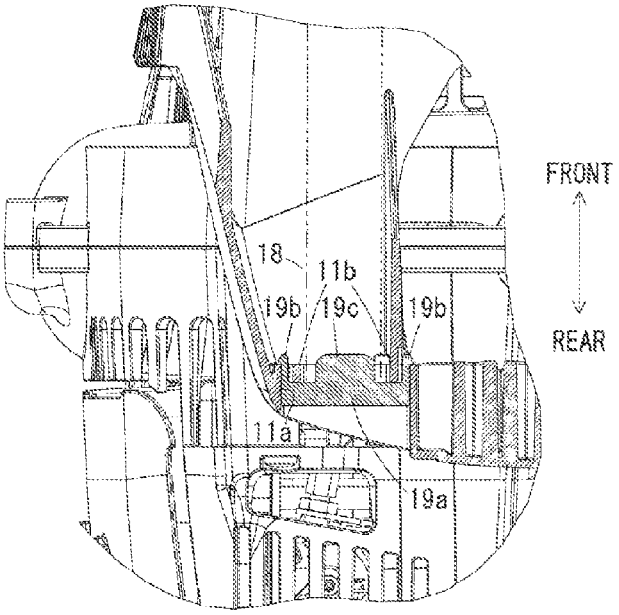
FIG. 5 is a sectional plan view taken along the arrowed line A-A of FIG. 4.

As shown in FIGS. 3-5, the hook 19 comprises a hook body 19*a* of a cylindrical shape for hitching the stabilizer strap 18. The longitudinal ends of the hook body 19*a* are each provided with a pawl 19*b* (with a sloping tooth) biased outward. These pawls 19*b* engage the right and left front edges of each of the retaining recesses 11*a* so that the hook shall not slip away rearward. In addition, at the right and left portions within each of the retaining recesses 11*a* are formed retaining bars 11*b* extending vertically to block the hook body 19*a* of the hook 19 so that the hook 19 shall not slip away frontward. The hook body 19*a* of the hook 19 is provided with a tongue 19*c* extending rearward to collide with the upper and lower belts of the stabilizer strap 18 hitched around the cylindrical hook body 19*a* so that the hook body 19*a* shall not rotate. When the hook 19 is to be removed from the back carrier frame 11, the right and left pawls 19*b* shall be elastically bent inward to disengage from both of the right and left front edges of the retaining recess 11*a* so that the hook 19 shall be slipped out rearward.

As shown in FIG. 1, the blower unit (power-driven work tool) 20 is mounted on the base support member. The blower unit 20 comprises a volute casing 21, a fan (impeller) 22 rotatably supported within the volute casing 21 and an engine (drive motor) 23 integrally combined with the volute casing 21 to rotate the fan 22. The volute casing 21 is formed, on its right side, with a blow-out duct 21*a* for blowing out the air which is taken in from the intake aperture in the front of the volute casing and impelled by the fan 22 in the volute casing 21. The blow-out duct 21*a* is fluidically connected to the airflow tube 24. A grip handle 25 is provided on the longitudinally middle part of the airflow tube 24 for the operator to hold the airflow tube 24 during the work. The grip handle 25 is provided with a throttle lever 26 for controlling the output power of the engine 23.

As shown in FIG. 2, the backpack blower apparatus 10 comprises an emergency release buckle device 30 at the coupling point of the upper strap 14*a* and the lower strap 14*b* of the left shoulder strap 14. The emergency release buckle device 30 is to normally couple the lower end of the upper strap 14*a*, the upper end of the lower strap 14*b* and the left end of the left half 16*a* of the chest strap 16 in use, and to quickly release the lower strap 14*b* and the left half 16*a* of the chest strap 16 from the upper strap 14*a* via a one part motion in an emergency. The emergency release buckle device 30 comprises a plug 31 at the upper end of the lower strap 14*b*, a plug 32 at the left end of the left strap 16*a*, and a socket 33 at the lower end of the upper strap 14*a*.

Figure 6A:
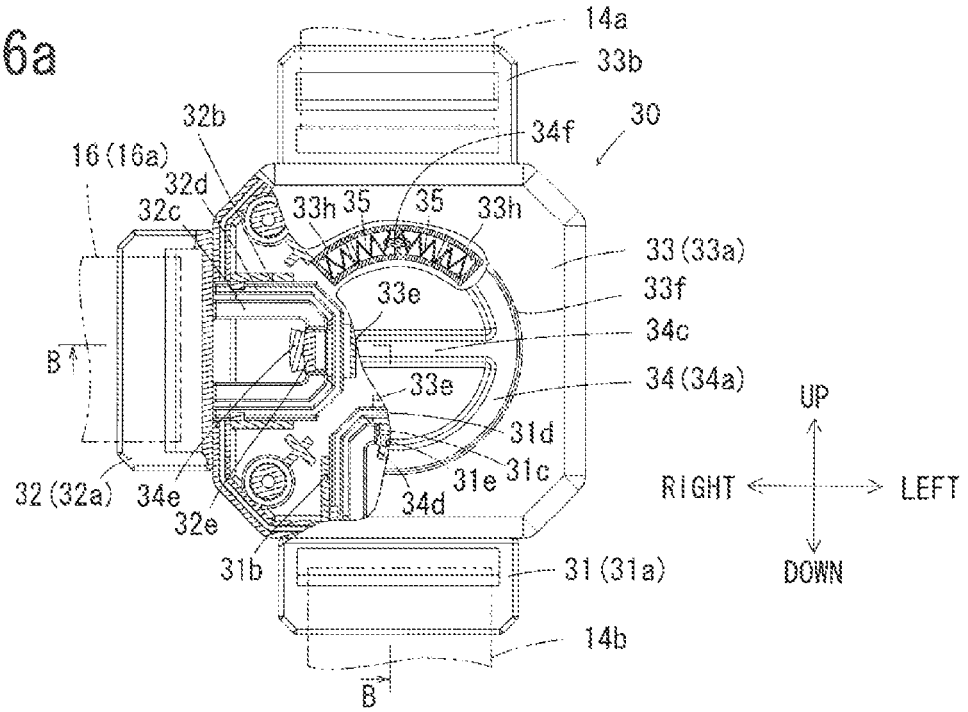
FIG. 6*a* is a partly-broken front view of the emergency release buckle device with the rotary latch in the locked position.
Figure 6B:
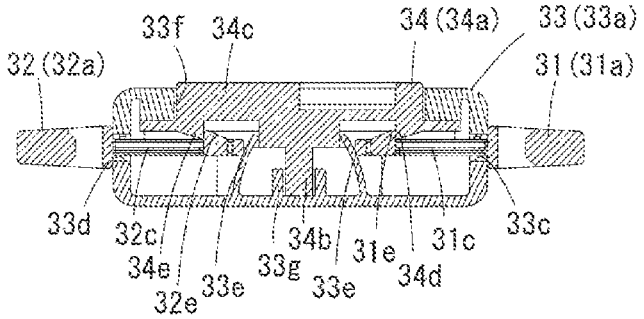
FIG. 6*b* is a sectional view taken along the arrowed line B-B of FIG. 6*a;*

As shown in FIGS. 6*a* and 6*b*, the plugs 31 and 32 are to couple the upper end of the lower strap 14*b* and the left end of the left strap 16*a*, respectively, to the socket 33 attached to the lower end of the upper strap 14*a*. The plug 31 is comprised of a belt fixing member 31*a* to which the upper end of the lower strap 14*b* is fixed and an inserting member 31*b* extending further from the belt fixing member 31*a* to be inserted into the socket 33. The inserting member 31*b* includes an inner member 31*c* and an outer member 31*d* both of generally U-shape. The inner member 31*c* and the outer member 31*d* are formed integrally with the belt fixing member 31*a* with the closed portion directed ahead. The inner member 31*c* of the inserting member 31*b* has, at its tip end, an engaging detent 31*e* (with a sloping tooth) projecting toward a rotary latch 34 (to be described hereinafter). The plug 32 is of the same configuration as the plug 31 and has a belt fixing member 32*a* to which the left end of the left strap 16*a* is fixed and an inserting member 32*b* extending further from the belt fixing member 32*a* to be inserted into the socket 33. The inserting member 32*b* includes an inner member 32*c* and an outer member 32*d* both of generally U-shape. The inner member 32*c* has, at its tip end, an engaging detent 32*e* projecting toward the rotary latch 34 (to be described hereinafter).

The socket 33 comprises a socket casing 33*a* of generally rectangular solid shape which is thin in the front-to-rear direction. The upper part of the socket casing 33*a* is integrally formed with a belt fixing member 33*b* to which the lower end of the upper strap 14*a* is fixed. The socket casing 33*a* has at its bottom and its right side, a plug receiving recesses 33*c* and 33*d* for receiving the plugs 31 and 32, respectively. The socket casing 33*a* is provided with leaf springs 33*e*, 33*e* projecting frontward (i.e. inward) from the rear wall of the socket casing 33*a* at the positions confronting the tip ends of the inserting members 31*b* and 32*b*, respectively, when the plugs 31 and 32 are inserted, the leaf springs 33*e*, 33*e* urging the tip ends of the inserting members 31*b* and 32*b* toward the directions of releasing the plugs 31 and 32 from the socket 33.

Further as shown in FIGS. 6*a* and 6*b*, the socket casing 33*a* has a front wall which is formed with a circular through hole 33*f* in the center thereof. A rotary latch 34 is provided in the through hole 33*f* of the socket casing 33*a*. The rotary latch 34 comprises a latch knob 34*a* in the shape of a circular disk with which a rotary shaft 34*b* is integrally formed extending toward inside of the socket casing 33*a* at the center of the latch knob 34*a* so that the rotary shaft 34*b* is rotatably supported within the tubular support member 33*g* on the rear wall (FIG. 6*b*). The latch knob 34*a* of the rotary latch 34 has on its front face a diametrical area and a circumferential area formed with recesses between the diametrical area and the circumferential area on both sides of the diametrical area, thereby providing along the diametrical area a pinch member 34*c* to be manipulated by the operator.

Figure 7A:
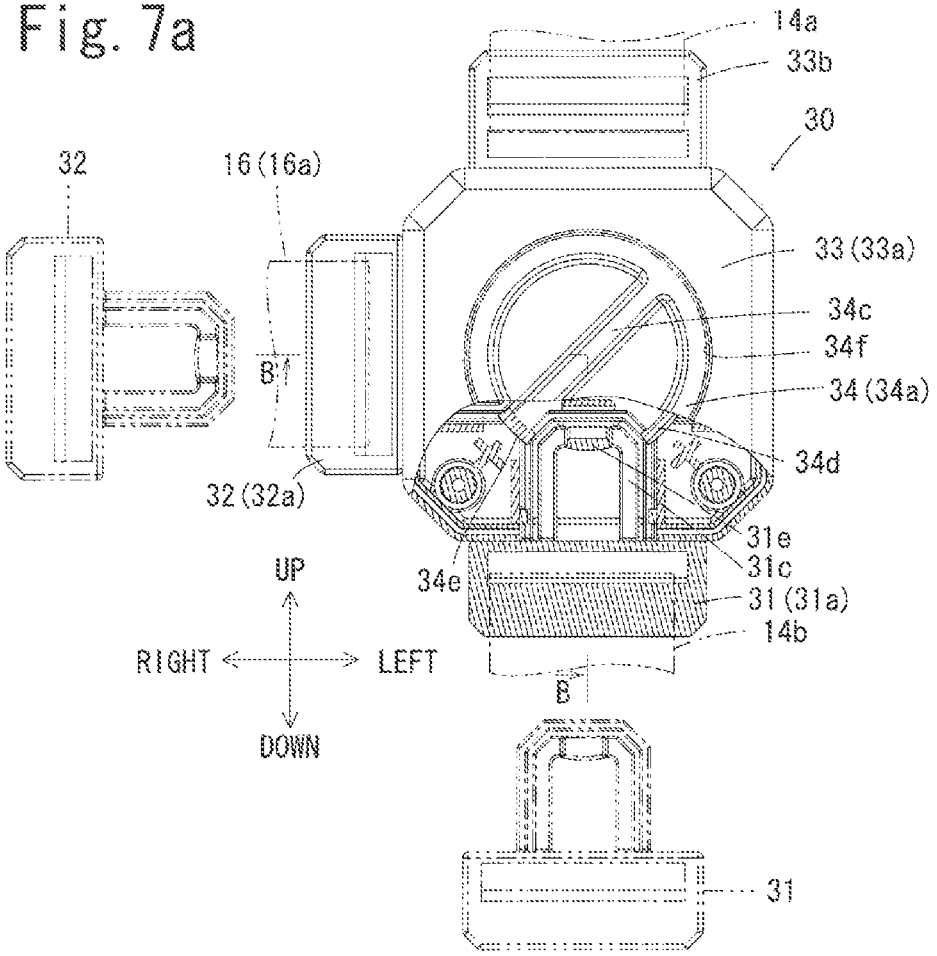
FIG. 7*a* is a partly-broken front view of the emergency release buckle device with the rotary latch in the released position.
Figure 7B:
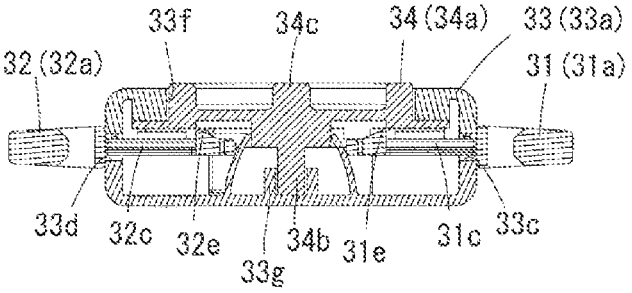
FIG. 7*b* is a sectional view taken along the arrowed line B-B of FIG. 7*a;*

On the rear surface of the rotary latch 34 is formed hook members 34*d* and 34*e* for engaging with the engaging dents 31*e* and 32*e* of the plugs 31 and 32, respectively. As seen in FIGS. 6*a* and 6*b*, the hook members 34*d* and 34*e* are formed in the lower part and the right part, respectively, of the rotary latch 34 when the rotary latch 34 assumes a locked position, in which the upper strap 14*a*, the lower strap 14*b* and the left strap 16*a* are to be kept coupled together. When the rotary latch 34 is in the locked position, the hook members 34*d* and 34*e* engage with the engaging detents 31*e* and 32*e* of the plugs 31 and 32, respectively, so that the plugs 31 and 32 are buckled in the socket 33. Where the rotary latch 34 are turned counterclockwise (or clockwise) by 45 degrees from the locked position, as shown in FIGS. 7*a* and 7*b*, to assume a released position (unlocked position), the hook members 34*d* and 34*e* are released from the engaging dents 31*e* and 32*e* of the plugs 31 and 32, respectively, and the plugs 31 and 32 will be pushed out from the socket 33 by the urging leaf spring members 33*e*, 33*e*, as depicted by dash-double dot lines in FIG. 7*a*.

As shown in FIG. 6*a*, the socket casing 33*a* is formed in the upper part thereof with two spring cases 33*h*, 33*h* extending along an arc to keep coil springs (urging means) 35, 35 inside. The rotary latch 34 is provided with a positioning protrusion 34*f* in its upper part on the rear face, protruding between the two coil springs 35, 35. The positioning protrusion 34*f* is urged toward the center position of the right to left direction by means of the coil springs 35, 35. In this condition where the positioning protrusion 34*f* is urged to the center position by the two coil springs 35, 35, the hook members 34*d* and 34*e* of the rotary latch 34 engage with the engaging detents 31*e* and 32*e* of the plugs 31 and 32, respectively, so that the plugs 31 and 32 are kept coupled to the socket 33, in other words, the rotary latch 34 is in the locked position. While the illustrated embodiment employs the coil springs 35, 35 to urge the rotary latch 34 to the locked position, the urging means may not necessarily be limited to this configuration, but may be of other elastic members such as leaf springs and rubber members for urging the rotary latch 34 to the locked position.

Herein below will be described how the backpack blower apparatus configured as above will work. To begin with, the upper strap 14*a*, the lower strap 14*b* and the left strap 16*a* are normally coupled together by means of the emergency release buckle device 30. The right and left straps 16*b* and 16*a* of the chest strap 16 are not coupled by the buckle 17. The right shoulder strap 15 and the right strap 16*b* of the chest strap 16 are inherently connected together. First, the operator starts the engine 23, puts on the right and left shoulder straps 15 and 14 on his/her shoulders to piggyback the backpack blower apparatus, and couples the right and left straps 16*b* and 16*a* of the chest strap 16 by the buckle 17. Under this condition, the operator holds the grip handle 25 of the airflow tube 24 with his/her right hand, manipulates the throttle lever 26, directs the distal end aperture 24*a* of the airflow tube 24 toward the ground to blow off fallen leaves lying on the ground.

In case something wrong should happen with the blower unit 20 while using the backpack blower apparatus 10, it might be necessary to quickly unshoulder the back carrier frame 11 on to the ground. In such a situation, the operator will disengage his/her right hand from the grip handle 25, and touch the emergency release buckle device 30 on his/her left chest to rotate the rotary latch 34 clockwise or counterclockwise by 45 degrees to the released position. Rotation of the rotary latch 34 to the released position removes the hook members 34*d* and 35*d* from the engaging dents 31*e* and 32*e* of the plugs 31 and 32, respectively, to release the plugs 31 and 32 from the socket 33 so that the lower strap 14*b* and the chest strap 16 (i.e. the left strap 16*a*) will be each decoupled from the upper strap 14*a*. Thus, the connection of the chest strap 16 (i.e. the left strap 16*a*) and the left shoulder strap 14 is cut off, and also the left shoulder strap 14 is divided into the upper strap 14*a* and the lower strap 14*b* so that the left shoulder of the operator will be free from any straps and that only the right shoulder strap 15 is on the operator's shoulder. Then, the operator can easily remove the right shoulder strap 15 from his/her body and put down the back carrier frame 11 with the mounted blower unit 20.

In the above described backpack blower apparatus 10, the left shoulder strap 14 is comprised of the upper strap 14*a* and the lower strap 14*b* which can be decoupled at the coupling point with the left strap 16*a* of the chest strap 16, and at the coupling point is provided the emergency release buckle device which normally couples the three straps, i.e., the upper strap 14*a*, the lower strap 14*b* and the left strap 16*a* when in use and can release two straps 14*b* and 16*a* apart among the three coupled straps 14*a*, 14*b* and 16*a* via one motion in case of emergency.

In this embodiment, the emergency release buckle device 30 comprises the two plugs 31 and 32 provided at the coupling ends, respectively, of the lower strap 14*b* of the left shoulder strap 14 and of the left strap 16*b* of the chest strap 16, the socket 33 fixed to the coupling end of the upper strap 14*a* of the left shoulder strap 14 and having the two plug receiving recesses 33*c* and 33*d* for receiving the plugs 31 and 32, and the rotary latch 34 rotatably provided on the socket 33 and having the two hook members 34*d* and 34*e* for detachably engaging with the engaging detents 31*e* and 32*e* of the plugs 31 and 32, respectively. When the rotary latch 34 is in the locked position, the two hook members 34*d* and 34*e* engage with the engaging detents 31*e* and 32*e*, respectively, of the two plugs 31 and 32, and when the rotary latch 34 is in the released position (unlocked position), the two hook members 34*d* and 34*e* disengage from the engaging detents 31*e* and 32*e*, respectively, of the two plugs 31 and 32 at a time. Thus, via one motion of rotating the rotary latch 34, the chest strap 16 can be decoupled from the left shoulder strap 14, and the left shoulder strap 14 can simultaneously be separated into the upper strap 14*a* and the lower strap 14*b* to slip off from the operator's left shoulder, so that only the right shoulder strap 15 remains on the operator's right shoulder and the operator has only to remove the right shoulder strap from the shoulder to put off the back carrier frame 11. Thus, the back carrier frame can be quickly put off.

In addition, as the two plugs 31 and 32 are released from the socket 33 by the manipulation of rotating the rotary latch 34, an inadvertent touch or push on the rotary latch 34 by the operator would not cause an accidental decoupling of the chest strap 16 or the left shoulder strap 14.

The positioning protrusion 34*f* of the rotary latch 34 engages with the coil springs 35, 35 within the socket 33, urging the rotary latch 34 to the locked position. The rotary latch 34 is thereby prevented from rotating from the locked position to the released position while the rotary latch 34 is not manipulated, which in turn prevents the chest strap 16 and the left shoulder strap 14 from being unintentionally decoupled. The latch knob 34*a* of the rotary latch 34 is in the shape of a circular disk and is formed on its front face with inwardly concave recesses between the diametrical area and the circumferential area on both sides of the diametrical area to provide the pinch member 34*c* along the diametrical area of the latch knob 34. According to this configuration, the pinch member 34*c* does not extend outward (i.e. frontward) from the surface of the latch knob 34. The pinch member 34*c* would not hit the operator's hand or so accidentally, which also prevents the rotary latch 34 from being rotated unintentionally.

While the plugs 31 and 32 are provided at the coupling ends of the lower strap 14*b* and the left strap 16*a*, respectively, and the socket 33 is provided at the coupling end of the upper strap 14*a* in the above described embodiment, the present invention is not limited to this configuration. The plugs may be provided at the coupling ends of the upper strap 14*a* and the lower strap 14*b*, respectively, and the socket 33 may be provided at the coupling end of the left strap 16*a*. Alternatively, the plugs may be provided at the coupling ends of the upper strap 14*a* and the left strap 16*a*, respectively, and the socked 33 may be provided at the coupling end of the lower strap 14*b*. Further alternatively, the coupling ends of the upper strap 14*a*, the lower strap 14*b* and the left strap 16*a* may be each provided with plugs, while the socket 33 may comprise three plug receiving recesses, so that the three plugs would be released from the socket by a single manipulation.

Figure 8A:
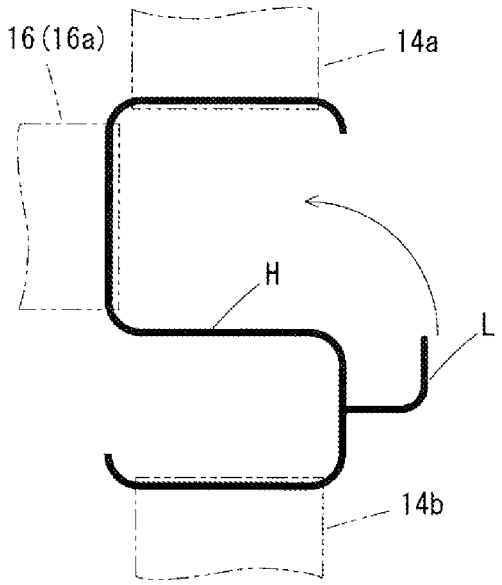
FIG. 8*a* is a schematic front view of a socket having an S-shaped hook for coupling the straps, wherein the S-shaped hook is in the position to couple the three straps.
Figure 8B:
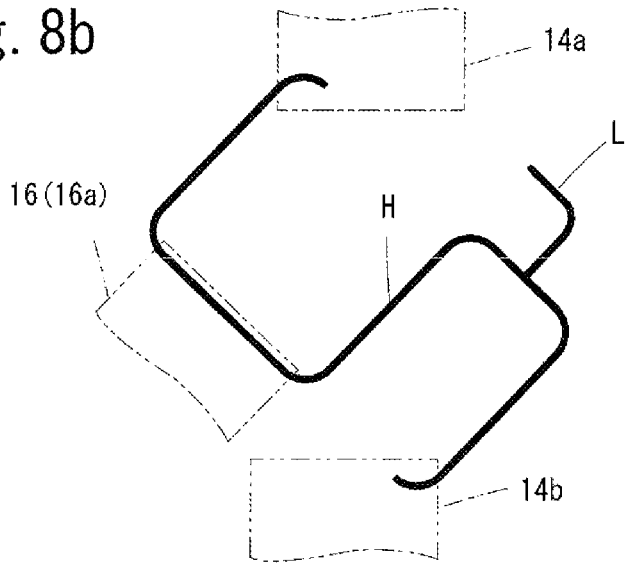
FIG. 8*b* is a schematic front view of the socket having the S-shaped hook for coupling the straps, wherein the S-shaped hook is rotated to the position to uncouple two of the three straps.

Alternatively to the above described embodiment, the socket may be configured with another type of hook member H with a release lever L as shown in FIGS. 8*a* and 8*b*. In FIG. 8*a*, the upper strap 14*a*, the lower strap 14*b* and the left strap 16*a* are coupled together by means of the hook member H. As the release lever L is turned counterclockwise as shown by the arrow in FIG. 8*a*, the upper strap 14*a* and the lower strap 14*b* will be decoupled from the hook member H as shown in FIG. 8*b*. This configuration also allows the release of the two straps 14*a* and 14*b* by a single manipulation, as in the case of the aforementioned embodiment.

While the embodiment described above is a backpack blower apparatus which blows out only air ahead, the invention is not necessarily limited to such an apparatus, but may be practiced in a backpack mist blower apparatus further carrying a chemicals tank for sprinkling insecticide, etc. together with the blown-out air. The backpack mist blower apparatus can also enjoy the same advantages according to the present invention.

Figure 9:
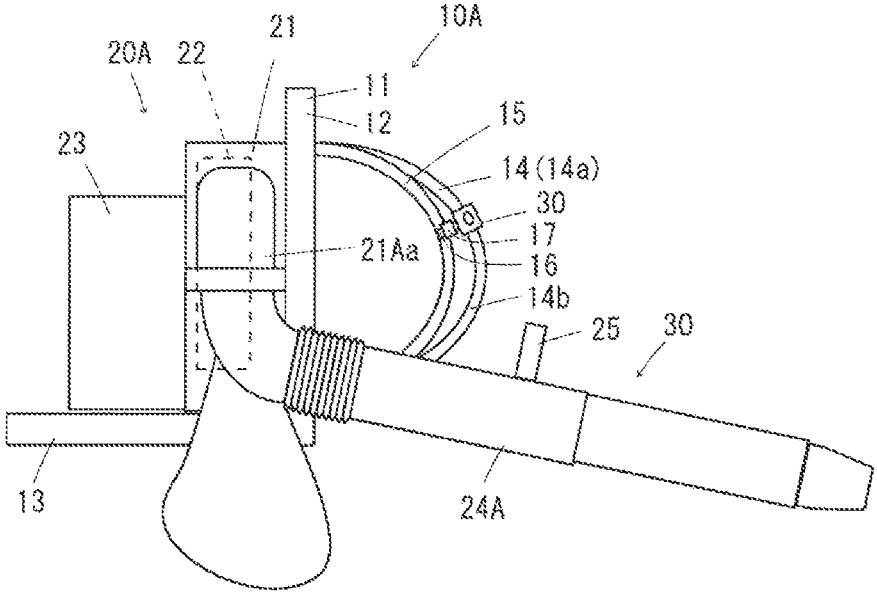
FIG. 9 is a side view rough sketch of a backpack suction apparatus as a second embodiment of the present invention.
Figure 10:
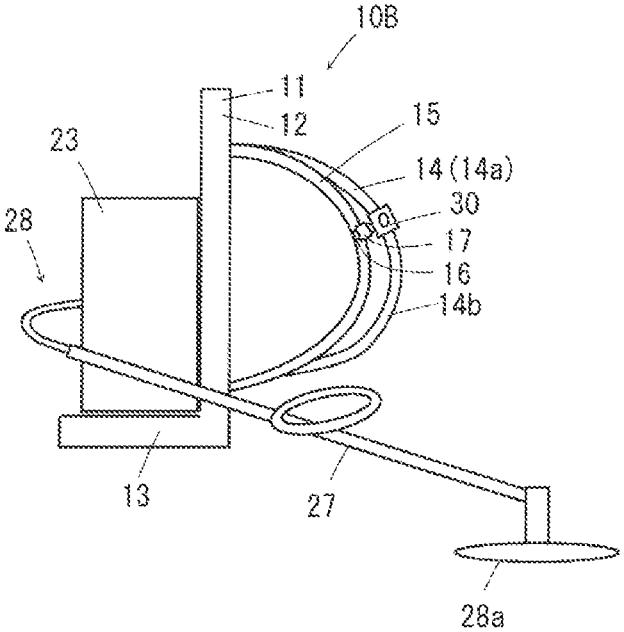
FIG. 10 is a side view rough sketch of a backpack vegetation cutter as a third embodiment of the present invention.

Further, while the embodiment of the backpack work apparatus has been described in connection with the backpack blower apparatus 10, the present invention is not necessarily limited to a backpack blower apparatus, but can be practiced in a backpack suction apparatus 1 OA as shown in FIG. 9, and a backpack vegetation cutter 10B as shown in FIG. 10, etc. More specifically, the backpack suction apparatus 10A comprises a back carrier frame 11 to be piggybacked by an operator, an engine (a drive motor) 23 mounted on the back carrier frame 11, a suction unit (a dust collector unit, i.e. a work tool) 20A driven by the engine 23 to suck in air, and a dust suction tube 24A equipped with a dust collecting bag (not shown) and connected to a suction duct 21Aa of the suction unit 20A. Similarly, the backpack vegetation cutter 10B comprises a back carrier frame 11 to be piggybacked by an operator, an engine (a drive motor) 23 mounted on the back carrier frame 11, and a rotary cutter 28*a* (a work tool) 28*a* rotatingly driven by the engine 23 via a drive shaft equipped within a frame rod (main pole) 27, constituting a vegetation cutter 28.

Also in the backpack suction apparatus 10A and in the backpack vegetation cutter 10B, the back carrier frame 11 includes a back support member 12 to which are connected a left shoulder strap 14 and a right shoulder strap 15. The left shoulder strap 14 is comprised of an upper strap 14*a* of which the upper end is fixed to the upper part of the back carrier frame 11 and a lower strap 14*b* of which the lower end is fixed to the lower part of the back carrier frame 11. The lower end of the upper strap 14*a* and the upper end of the lower strap 14*b* are detachably coupled together. The left strap 14 and the right strap 15 are linked by a chest strap 16 in front of the operator's chest. The chest strap 16 is comprised of a left strap 16*a* and a right strap 16*b*, which two are detachably coupled together by means of a buckle 17. The coupling ends of the upper strap 14*a*, the lower strap 14*b* and the left strap 16*b* are coupled together by means of an emergency release buckle device 30. The emergency release buckle device is to normally couple the coupling ends of the three straps 14*a*, 14*b* and 16*a* together when in use and to decouple the lower strap 14*b* and the left strap 16*a* from the upper strap 14*a* via a one part manipulation. The structure of the emergency release buckle device is the same as that in the above described backpack blower apparatus 10.

While the engine 23 is mentioned as the drive motor in the apparatus in the above described embodiments, the present invention is not necessarily limited to such a configuration, but may be with an electric motor energized by electric power supplied from a battery, etc.

While the emergency release buckle device 30 is provided to couple the upper strap 14 and the lower strap 14*b* of the left shoulder strap 14, and the left strap 16*a* of the chest strap 16 in the embodiments described above, the present invention is not necessarily limited to such a configuration, but may be provided to couple the right strap 15 and the chest strap 16 by dividing the right strap 15 into an upper right strap and a lower right strap and detachably coupling the right end of the chest strap 16 with the upper right strap and the lower right strap by means of an emergency release buckle device 30. This configuration can also enjoy the same advantages as the aforementiond embodiments.

The invention claimed is:

1. A backpack work apparatus comprising:

a back carrier frame to be piggybacked by an operator, the back carrier frame having an upper part and a lower part;

a drive motor mounted on the back carrier frame;

a work tool driven by the drive motor;

a pair of right and left shoulder straps each coupled to the back carrier frame for the operator to piggyback the back carrier frame, each of the shoulder straps having an upper end, a lower end and an intermediate point, the upper end being connected to the upper part of the back carrier frame and the lower end being connected to the lower part of the back carrier frame;

a chest strap for linking the right and left shoulder straps, the chest strap having a first end joined to the intermediate point of one of the shoulder straps and a second end joined to the intermediate point of another of the shoulder straps; and an emergency release buckle device provided at the point where the first end of the chest strap is joined to the intermediate point of the one of the shoulder straps, the buckle device dividing the one of the shoulder straps into two parts, an upper strap and a lower strap, the upper strap forming a first coupling end toward the buckle device, the lower strap forming a second coupling end toward the buckle device and the first end of the chest strap constituting a third coupling end toward the buckle device, the buckle device normally buckling the first coupling end, the second coupling end and the third coupling end together, and being capable of releasing at least two of the first, second and third coupling ends from the buckle device via a one part motion.

2. A backpack work apparatus as claimed in claim 1, wherein the emergency release buckle device includes: two plugs respectively provided at two of the first, second and third coupling ends; a socket fixed to the remaining one of the first, second and third coupling ends, the socket having two recesses for respectively receiving the two plugs; and a rotary latch rotatably provided on the socket to assume a locked position and a released position and having hook members for selectively latching both of the plugs when the rotary latch is in the locked position and unlatching both of the plugs when the rotary latch is in the released position via a one part motion.

3. A backpack work apparatus as claimed in claim 2, wherein the socket is provided with an urging member for urging the rotary latch to the locked position to normally latch both of the plugs.

4. A backpack work apparatus as claimed in claim 3, wherein the rotary latch includes a latch knob in the shape of a circular disk having a diametrical area and a circumferential area and formed with recesses between the diametrical area and the circumferential area on both side of the diametrical area, thereby providing along the diametrical area a pinch member to be manipulated by the operator.

5. A backpack work apparatus as claimed in claim 2, wherein the rotary latch includes a latch knob in the shape of a circular disk having a diametrical area and a circumferential area and formed with recesses between the diametrical area and the circumferential area on both side of the diametrical area, thereby providing along the diametrical area a pinch member to be manipulated by the operator.

* * * * *